United States Patent [19]

Turner

[11] 4,245,835

[45] Jan. 20, 1981

[54] SHEET STORING APPARATUS

[75] Inventor: George F. A. M. Turner, Blackmore, England

[73] Assignee: Ciba-Geigy AG, Basel, Switzerland

[21] Appl. No.: 18,398

[22] Filed: Mar. 8, 1979

[30] Foreign Application Priority Data

Mar. 14, 1978 [GB] United Kingdom ..... 9941/78

[51] Int. Cl.[3] ..... B65H 9/00

[52] U.S. Cl. ..... 271/226; 271/164; 271/259; 271/272; 250/468

[58] Field of Search ..... 271/162, 164, 6, 10, 271/258, 259, 272, 277, 226; 250/468

[56] References Cited

U.S. PATENT DOCUMENTS

| | | | |
|---|---|---|---|
| 3,147,970 | 9/1964 | Davidson | 271/259 |
| 3,276,769 | 10/1966 | Kallenberg | 271/10 |
| 3,863,913 | 2/1975 | Hirafuji | 271/270 X |
| 3,893,662 | 7/1975 | Boyd | 271/273 X |
| 3,968,365 | 7/1976 | Sohngen | 200/338 |
| 4,014,536 | 3/1977 | Hope | 271/162 |
| 4,067,566 | 1/1978 | Williams | 271/6 X |

*Primary Examiner*—Richard A. Schacher

*Attorney, Agent, or Firm*—Harry Falber

[57] ABSTRACT

A film storage device that is placed between an X-ray film cassette and X-ray film processor. The device is capable of storing three X-ray films at a time and enables an operator to reduce the waiting time for a typical set of three films per patient to be made available.

Each film drops from the cassette into a light tight enclosure where it engages the nip of a S shaped system of rollers and belts. The film is carried fast to the end of the belt system where a curved plate and roller system delivers it to a slower travelling set of rollers which are part of the processor. The curved plate and rollers ensure that the X-ray film is appropriately curved and in compression as it awaits processing. An electrical indicating device on the processor is connected electrically to a switch on the fast S shaped roller system. The operation of these controls ensures that the delivery of film to the processor can be halted if necessary while the first film is being processed. If a third film is introduced to the system the set of controls ensures that the films are stored either in the S-shaped roller-and-belt assembly or in the light tight delivery enclosure until the processor is capable of handling them.

12 Claims, 6 Drawing Figures

SHEET STORING APPARATUS

This invention relates to apparatus for use in the daylight handling of photographic sheet film.

Until recently film sheets and in particular X-ray film sheets were handled by loading the film sheet into a cassette in the dark, exposing it under daylight conditions and then taking the cassette into a darkroom, opening it and placing the film sheet into a processor all in the dark. However various systems have been proposed for the total handling of photographic film sheets and in particular X-ray film sheets (or radiographs) in daylight conditions. The apparatus required for this includes a bulk storage device for storing film sheets and dispensing them into a cassette placed therein; this bulk storage device may be present in the area in which the cassette is to be used. The charged cassette is removed from the bulk storage device and exposed. The cassette is then placed in a cassette unloader which unloads the film from the cassette and feeds it into a film processor. All these operations can be carried out under normal daylight conditions.

Although the speed of film processors has been increased very substantially in recent years, nevertheless this constitutes a time lag between exposing an X-ray film and receiving the developed and dried film for inspection. Thus there is a need to have an intermediate storage device into which exposed films may be rapidly charged but which can continue to pass films to the processor which processes them at its own speed. Such an intermediate storage device can conveniently be combined with the cassette unloader.

In some apparatus for such a use the cassettes are unloaded into a bulk storage system and film sheets are fed from this system to the film processor. Apparatus of this type are described for example in German published patent No. 2,244,609, British patent No. 1,100,681 and French patent No. 1,434,529.

In other cassette unloading devices, for example in British patent No. 961,440, sets of rollers convey the film sheet from the cassette to the processing apparatus. The speed of the rollers may be regulated so that the cassette is emptied faster than the film is fed to the processor.

In other prior described apparatus use is made of a shute into which the film is fed from the cassette. Exemplary of such apparatus are those described in U.S. Pat. Nos. 2,721,078 and 4,014,536. However in such apparatus no provision is made for storing film sheets apart from the shute.

However from observation in hospitals it has been found that on average, 2.8 radiographs are taken of each patient. Thus it is highly desirable that the intermediate storage device should be capable of holding three X-ray films and that these should be delivered in the order in which they were taken to the radiologist for inspection.

It is the object of the present invention to provide a relatively simple cassette unloading device which can hold at least three film sheets and which presents them sequentially to a film processor.

According to the present invention there is provided an apparatus for receiving a plurality of sheet films from film cassettes and presenting them in seriatim to an associated film processor, the apparatus comprising a light-tight enclosure having a film cassette introduction port and a film exit port located in light-tight operational contact with an associated film processor, the film cassette introduction port being adapted to receive a film sheet from a cassette which is opened when its openable end is introduced therein, a film sheet transference means comprising a pair of endless driven belt systems, the path of the pair of belts running substantially parallel for sufficient length to hold therebetween in the parallel section of the path at least one film sheet, the transference means having a film sheet loading port located below the said introduction port and a film sheet discharging port for discharging film sheets held between the pair of belt systems, the said film sheet discharging port comprising a pair of rollers so located to present a film sheet being discharged therebetween to the associated film processor through the film exit port.

Preferably a film sheet falls by gravity from the cassette into a shute. Also preferably a film sheet falls by gravity from the shute to the film sheet loading port of the film sheet transference means.

Means may be provided for rendering light-tight the bottom end of the shute.

Preferably the apparatus is arranged to feed the film sheet from the said film sheet discharging port to the film processor at a higher rate than the film is received into the film processor, there being provided a space in the enclosure which enables the film to accumulate between the film sheet discharging port and the entrance to the processor by being bowed therebetween.

In practice the entrance to the processor usually comprises a pair of nip rollers and this pair of nip rollers is arranged to rotate at a substantially lower rate than the pair of rollers which constitutes the film sheet discharging port.

Preferably means are provided to help bow the film between the film sheet discharging port and the entrance to the film processor. Most preferably there is provided a platform between the film sheet discharging port and the entrance to the film processor, this said platform being curved up at its centre towards the path of the film. Means may also be provided for defining the shape of the bowed film. This means may include either a curved member or an array of rollers located close to the film exit port and above the path of the film. Also a curved member or an array of rollers may be located close to the film sheet discharging port and also above the path of the film sheet. Most preferably this latter curved member or array of rollers is so positioned that when the trailing edge of the film sheet leaves the said discharging port, it is forced down into a channel formed in the curved platform and adjacent the film sheet discharging port.

Most preferably the length of the substantially parallel path of the pair of belt systems is sufficient to accommodate one film sheet only. Thus in the preferred embodiment three film sheets may be stored in the apparatus. That is to say, the first film sheet is stored in a bowed position between the film sheet discharging port and the entrance port to the processor, the second sheet is stored between the pair of belt systems and the third is stored in the shute.

However it is possible to provide a greater length of substantially parallel path of the pair of belt systems in which three sheets of film can be stored. In this case there need not be a shute or film bowing chamber.

Preferably in the preferred embodiment means are provided in the apparatus for sensing when a film sheet leaves a particular section of the apparatus. Thus means may be provided for sensing when the trailing edge of the film sheet passes wholly into the film processor.

Also means may be provided for sensing when a film sheet is stored between the pair of belt systems. When two such sensing means are provided the driven belt systems can be arranged to operate continuously when neither or only one sensing means senses a film sheet. When both sensing means sense a film sheet the driven belt systems at once stop but restart when a film sheet is no longer sensed by one of the said sensing means. A further means may be provided for ensuring that the enclosure is light-tight at the cassette introduction port before the film exit port is opened.

The accompanying drawings will serve to illustrate one embodiment of the invention.

In all the figures the same numbers have the same signification.

Figure 1:
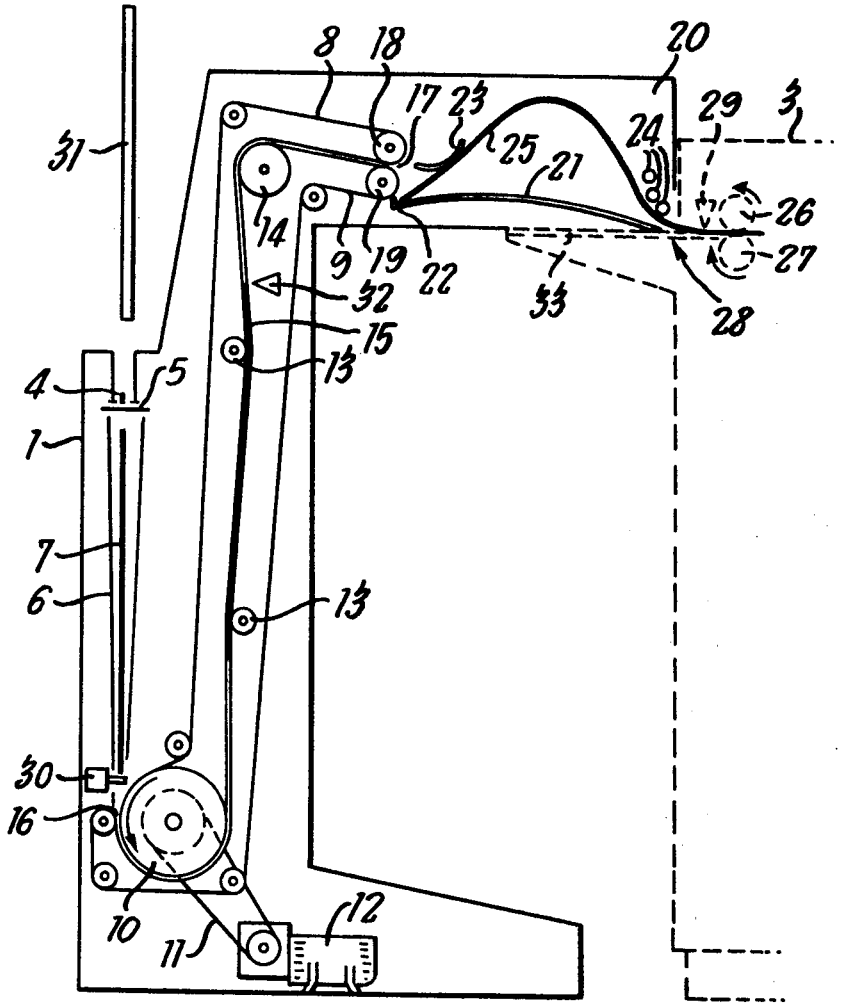
FIG. 1 is a cross sectional diagrammatic view of an apparatus according to the present invention.

In FIG. 1 the apparatus comprises light-tight enclosure 1 and associated therewith, in a light-tight manner, a film processing apparatus 3 which is indicated by a dotted outline.

The light-tight enclosure 1 comprises a film cassette introduction port 4 and means 5 for closing off the film cassette introduction port 4 and rendering the light-tight enclosure 1 light-tight.

The light-tight enclosure 1 further comprises a pair of belt systems 8 and 9. This pair of belt systems are driven by a driven roller 10 which is in its turn driven by a belt 11 from a motor 12. The pair of belt systems 8 and 9 pass over a large number of rollers, some of which are indicated in the figures by the numeral 13. Each belt system comprises two narrow belts arrayed over each roller. From roller 10 to roller 14 the path of the pair of belt systems is substantially parallel and a film 15 is shown held therebetween. Also present in the light-tight enclosure 1 is a shute 6 in which a film 7 is shown stored. A film entrance port 16 is located below the shute 6. A film discharging port 17 is formed by the pair of nip rollers 18 and 19.

Present between the film discharging port 17 and the processing apparatus 3 is the bowing section 20 of enclosure 1. The bowing section 20 comprises a curved platform 21 which has a channel 22 at end thereof. Arrayed over the curved platform 21 is a curved member 23 and an array of three rollers 24. Shown in a bowed position between the platform 21, the curved member 23 and the array of rollers 24 is a film 25. One end of the film 25 is shown between the pair of nip rollers 26 and 27 which constitute the entrance port of the film processor 3. The film exit port 28 is adjacent to the film processor 3.

At the entrance to the film processor 3 is shown a sensing means 29 which senses when the trailing edge of a film has passed therebeneath.

Also shown in FIG. 1 is a solenoid 30 which activates the closable means which shut off the bottom of the shute 6.

Shown above the cassette entry port 4 is a film cassette 31. Located along the parallel path of the belt systems 8 and 9 is a sensor 32. The curved platform 21 rests on a platform 33 of the processor 3.

In operation a film cassette 31 is introduced into the film cassette introduction port 4. This causes the closure means 5 to open and also opens the cassette 31. A film then falls out of the cassette 31 into the shute 6 where it is retained by the closure means associated with the solenoid 30. The motor 12 is then switched on and this causes the roller 10 to drive the pair of belt systems 8 and 9. This causes the solenoid 30 to be activated and the film sheet stored in the shute 6 falls into the film entrance port 16 and is carried by the pair of belt systems round to the film discharging port 17 where it is driven forward until its leading edge meets the pair of nip rollers 26 and 27 in the film processing machine 3. Further pressure exerted on it by the driven pair of belt systems causes the film to bow. When the trailing edge of the film 25 passes out of the film discharging port 17 the curved member 23 causes the trailing edge 25A to flip down into the channel 22, as shown in FIG. 1.

The film processor 3 is already operating and the driven nip rollers 26 and 27 will gradually drive the film in the bowing section 20 into the film processing machine 3. At the same time another cassette 31 can be introduced into the cassette introduction port 4 and another film will fall into the shute 6 and when the closure 5 has closed this film will fall into the entrance port 16 and will be driven up to the position occupied by film 15. There it will be sensed by sensor 32. Then as the sensing device 29 will still be sensing the first film the roller 10 will then be caused to stop. However a third cassette can then be introduced into the cassette introduction port 4 and the closure 5 opened and a third film will then fall into the shute 6 and the closure 5 will then be closed.

As soon as the trailing edge of the first film passes the sensing device 29 the motor 12 activates the roller 10 and the film stored in position 15 will be driven to the film discharging port 17 and this film will then enter the bowing section until it reaches the pair of nip rollers 26 and 27 and it will then be bowed in the bowing section 20. This film sheet will be sensed by sensor 29 but as sensor 32 will not be sensing any film sheet the roller 10 will continue to drive the pair of belt systems. As soon as the roller 10 starts to rotate the solenoid 30 can then be caused to operate and this will allow the third sheet of film stored in the shute 6 to fall into the film entrance port 16 and be carried up to position 15. If required a further cassette can then be introduced into the cassette introduction port 4.

Figure 2:
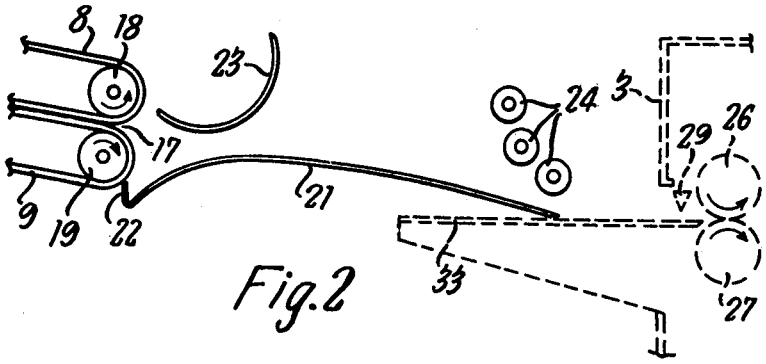
FIGS. 2 to 6 show an enlarged view of the bowing section. These show the receipt of a film sheet therein and how it becomes bowed in the course of operation.

FIG. 2 shows in greater details the bowing chamber 20 including the pair of nip rollers 26 and 27, the film discharging port 17 and the film exit port 28. The curved member 23 and the array of rollers 24 both of which are over the curved platform 21 which comprises the channel 27 at one end. The top of the processing machine 3 is indicated by the platform 33.

Figure 3:
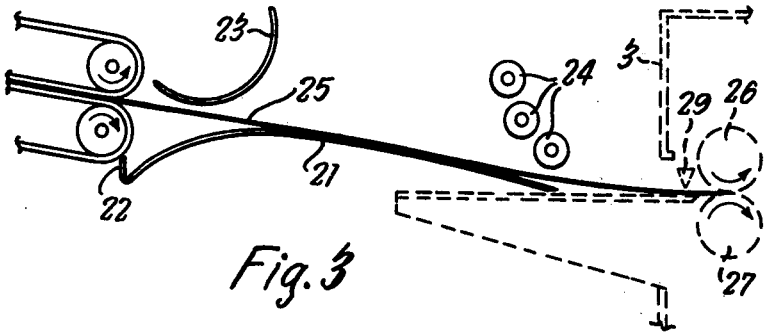
Figure 4:
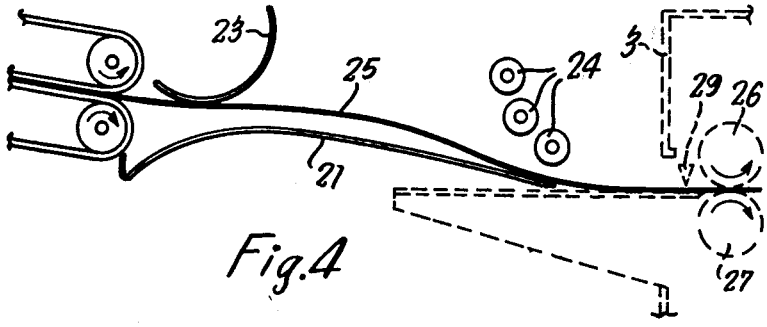
Figure 5:
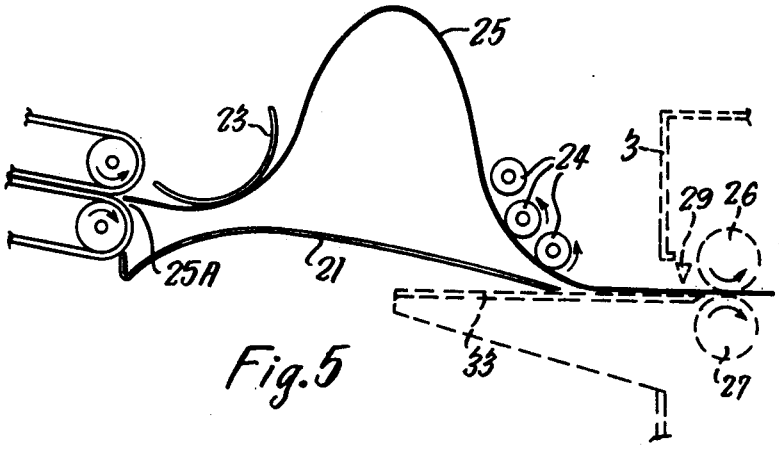
Figure 6:
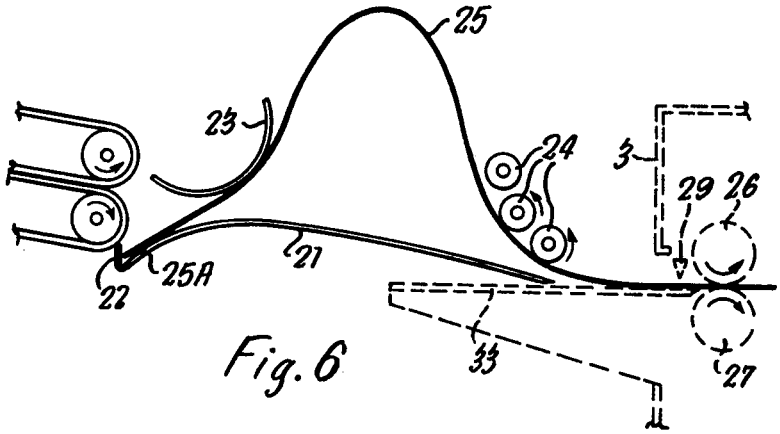

In FIG. 3 a film 25 is shown being driven out of the film discharging port 17 and its leading edge is shown between the pair of nip rollers 26 and 27 which are rotating but at much slower rate than the pair of nip rollers 18 and 19. This causes the film 25 to start to bow as shown in FIG. 4. Thus as all the film is driven out of the film discharging port 17 it is bowed to a considerable extent as shown in FIG. 5. Finally as is shown in FIG. 6 the end of the film 25A will flex down into the channel 22.

I claim:

1. An apparatus for receiving a plurality of sheet films from film cassettes and presenting them in seriatim to an associated film processor, the apparatus comprising a light-tight enclosure having a film cassette introduction port and a film exit port located in light-tight operational contact with an associated film processor, the film cassette introduction port being adapted to receive a film sheet from a cassette which is opened when its openable end is introduced therein, a film sheet transference means comprising a pair of endless driven belt systems, the path of the pair of belts running substantially parallel for sufficient length to hold therebetween in the parallel section of the path at least one film sheet, the said transference means having a film sheet entrance port located below the said introduction port and a film sheet discharging port for discharging film sheets held between the pair of belt systems, the said film sheet discharging port comprising a pair of rollers so located to present a film sheet being discharged therebetween to the associated film processor through the film exit port, and a space in the enclosure located between the film sheet discharging port and the entrance to the processor for accumulating film sheets therein in bowed configuration, said film sheets accumulating in said space by being fed from said discharging port to the film processor at a rate faster than that at which the film is delivered into the film processor.

2. An apparatus according to claim 1 so constructed that a film sheet is enabled to fall by gravity from a cassette into a shute located beneath the film cassette introduction port.

3. An apparatus according to claim 2 so constructed that a film sheet located in the shute is enabled to fall by gravity from the shute to the film sheet loading port of the film sheet transference means.

4. An apparatus according to either claim 3 wherein means are provided for rendering light-tight the bottom end of the shute.

5. An apparatus according to claim 1 wherein means are provided to help bow the film between the film sheet discharging point and the entrance to the film processor.

6. An apparatus according to claim 5 wherein the means provided to help bow the film include a platform located between the film sheet discharging port and the entrance to the film processor, the said platform being curved up at its centre towards the path of the film.

7. An apparatus according to any one of claims 1-4, 5 or 6, wherein means are provided for defining the shape of the bowed film, which means comprises a curved member located close to the film exit port and above the path of the film.

8. An apparatus according to claim 7 wherein the curved member is so positioned that when the trailing edge of the film sheet leaves the said film discharging port it is forced down into a channel formed in the curved platform and adjacent to the film sheet discharging port.

9. An apparatus according to claim 1 wherein the length of the substantially parallel path of the pair of belt systems is sufficient to accommodate one film sheet only.

10. An apparatus according to claim 1 wherein means are provided for sensing when a film sheet leaves a particular section of the apparatus.

11. An apparatus according to any one of claims 1-4, 5, 6, 9 or 10, wherein means are provided for defining the shape of the bowed film, which means comprises an array of rollers located close to the film exit port and above the path of the film.

12. An apparatus according to claim 11, wherein the array of rollers is so positioned that when the trailing edge of the film sheet leaves the said film discharging port it is forced down into a channel formed in the curved platform and adjacent to the film sheet discharging port.

* * * * *